US006626499B1

(12) United States Patent
Schenk et al.

(10) Patent No.: US 6,626,499 B1
(45) Date of Patent: Sep. 30, 2003

(54) DEVICE FOR BREAKING UP THE OUTER LAYERS OF THE GROUND

(76) Inventors: Jurgen Schenk, Haussmannstrasse 34, D-70188 Stuttgart (DE); Karl-Otto Heber, Auchterstrasse 9, D-73278 Schlierbach (DE)

( * ) Notice: Subject to any disclaimer, the term of this patent is extended or adjusted under 35 U.S.C. 154(b) by 0 days.

(21) Appl. No.: 09/890,373

(22) PCT Filed: Jan. 26, 2000

(86) PCT No.: PCT/DE00/00215

§ 371 (c)(1),
(2), (4) Date: Jan. 23, 2002

(87) PCT Pub. No.: WO00/53855

PCT Pub. Date: Sep. 14, 2000

(30) Foreign Application Priority Data

Jan. 29, 1999 (DE) ..... 199 03 528

(51) Int. Cl.[7] ..... E02F 3/28; E02F 3/78; E02F 3/96

(52) U.S. Cl. ..... 299/39.2; 299/39.1; 37/379; 37/444; 37/903

(58) Field of Search ..... 299/39.2, 39.3, 299/39.4, 36.1; 37/903, 444, 445, 379

(56) References Cited

U.S. PATENT DOCUMENTS

| | | | | |
|---|---|---|---|---|
| 2,755,092 A | | 7/1956 | Donahoe | |
| 3,595,411 A | | 7/1971 | Ables | |
| 4,089,431 A | * | 5/1978 | Stedman | 37/445 |
| 4,793,732 A | | 12/1988 | Jordon | |
| 4,803,789 A | | 2/1989 | Hackmack | |
| 4,878,713 A | | 11/1989 | Zanetis | |
| 5,423,137 A | | 6/1995 | Cochran | |
| 6,085,446 A | | 7/2000 | Posch | |

FOREIGN PATENT DOCUMENTS

| | | | |
|---|---|---|---|
| DE | 4213523 A | | 10/1993 |
| DE | 19727549 A | | 2/1999 |
| EP | 0922811 A | | 6/1999 |
| WO | WO 9110016 A | | 7/1991 |
| WO | WO 99/00555 | * | 1/1999 |

* cited by examiner

*Primary Examiner*—Heather Shackelford
*Assistant Examiner*—Sunil Singh
(74) *Attorney, Agent, or Firm*—Leydig, Voit & Mayer, Ltd.

(57) ABSTRACT

For the breaking-up and removal of ground outer layers there serves an device that is constructed as a dredge shovel. On its rear side lying opposite the receiving opening it is provided with a milling and cutting arrangement that has a predetermined milling (or cutting) depth and that serves for the penetration of pavement layers or similar outer layers, as well as for their breakdown into a workable recycling material.

22 Claims, 6 Drawing Sheets

DEVICE FOR BREAKING UP THE OUTER LAYERS OF THE GROUND

FIELD OF THE INVENTION

The invention relates to an arrangement for the breaking up and taking up of outer layers of the ground, such as, for example, frozen ground, concrete surfaces, asphalt.

BACKGROUND OF THE INVENTION

In many cases it is necessary to break up and to remove outer layers that are relatively hard. It is frequently desired to restrict this only to limited areas, while adjacent zones are to remain unaffected. For example, in the laying of lines of different types it can be necessary to open up ditches, in which operation the ditches must in many cases cross asphalt-coated or concrete-coated surfaces, or surfaces provided with another coating. In other cases, too, it can become necessary to remove outer layers.

The sub-ground into which the ditches are to be made consists occasionally of cohesive soil. It can also happen, however, that the ground is rocky. For the digging of ditches, troughs, pits or other depressions, there serve as a rule dredges with corresponding dredge shovels. In order to enable the digging of ditches even in the case of difficult ground relations and in the case of sealed ground provided with relatively resistant outer layers (street paving), it has already been proposed to combine a dredging shovel with a milling arrangement. The milling arrangement is arranged on the open front of the dredging shovel.

When working in cohesive soils the use of a milling arrangement is frequently unnecessary.

BRIEF SUMMARY OF THE INVENTION

In view of the foregoing an object of the invention is to create a versatilely usable device for the breaking up of outer layers of the ground. Furthermore, it is an object of the invention to create a corresponding process which permits an efficient operation.

In the arrangement according to the invention, a receiving arrangement that is configured for the taking-up and local removal of excavated material is combined with a milling and cutting arrangement which allows penetration through concrete stone or asphalt layers, or frozen ground. The milling and cutting arrangement is preferably constructed in such manner that it makes possible a more or less smooth cut which separates the areas to be broken up from zones that are not to be removed and that are to remain undamaged. If, for example, a trench is to cross a street, the pavement must be removed in the zone of the trench; the rest of the outer layer is not to be loosened up. Conventionally, a separating cut is made into the pavement with diamond saws, in order to prevent the possibility that in the opening of the trench relatively large parts of the adjoining pavement will be torn out or damaged. The milling and cutting arrangement makes the separating cut dispensable, and it removes the pavement only in the requisite zone. It has preferably a milling and cutting rotor which is provided with corresponding chisels and leaves an essentially smooth border cut. For the drive of the milling and cutting arrangement a drive arrangement is provided in the trench opening arrangement. A holding and guiding arrangement carries both the milling and cutting arrangement and also the receiving arrangement and the drive arrangement, which are firmly joined with one another, and it permits their positioning in order to mill ground layers and to excavate trenches.

The receiving arrangement has a free receiving opening; i.e. the milling and cutting arrangement is not arranged in the zone of the receiving opening of the receiving space. Thereby the undisturbed taking up of loosened rubble is possible independent from the operation of the milling and cutting arrangement. The arrangement can be altogether, if so needed, like a dredger shovel, without it driving the milling and cutting arrangement. The lift-off from cohesive soils, which under some circumstances could clog a milling and cutting arrangement, thereby becomes possible without hindrance.

The milling and cutting arrangement can have several motors. In a preferred embodiment, however, it has only a single rotor fitted out with chisels or other cutting tools. The latter is constructed as a disk or roller milling tool and permits a milling depth of at least 20 cm, but preferably of 30 cm or more. Thereby it becomes possible to excavate pavement and if necessary at least a part of the substructure in one operation. Furthermore it thereby becomes possible to get along with relatively narrow rotors, which do not extend over the entire width of the dredge shovel (receiving arrangement). This permits for example achieving relatively great milling depths with moderate performance of the drive arrangement. The removal of the outer layer over a trench to be opened occurs then in several working steps, as the outer layer is milled up stripwise, laterally offset.

The milling and cutting rotor is preferably accommodated in a chamber arranged on the rear side of the receiving arrangement, from which it projects with one section. Thereby it becomes possible to use the receiving arrangement and the milling and cutting rotor independent from one another. In the milling of ground outer layers or of relatively hard stone layers the receiving arrangement is not in the way and in the taking up of rubble the milling arrangement is not an obstruction. It is advantageous if the milling and cutting rotor has a diameter that is greater than half the height of the rear side of the receiving arrangement. Thereby again the above-mentioned great milling depths are possible.

The regulating of the milling depth occurs preferably by means of a support strip, support skid or support plate which is supported on the not-yet-loosened material of the outer layer. The strip, skid or plate can be arranged in a working direction in front of, or beside, the rotor.

Adjacent to the rotor and at a distance therefrom there is preferably arranged a stop strip, past which the chisels run. By regulating the spacing between the chisel pieces and the stop strip the granulation of the resulting fragmented material can be regulated. With suitable adjustment there is yielded a relatively uniform granulation of the material.

The receiving arrangement can have a flat underside. This is advantageous especially for the development of level trench bottoms. Here it is appropriate if the cutting and milling, in the case of a horizontally maintained underside, is arranged above the same. The axis of rotation of the milling and cutting rotor is arranged at a distance from the underside that is greater than the radius of the milling and cutting rotor, in order to make this possible.

Between the chamber receiving the milling and cutting arrangement and the receiving arrangement there can be arranged an inter-wall or partition. This can be made completely continuous in order to completely separate the milling and cutting arrangement from the receiving arrangement. If need be it is also possible to provide the partition with a passage opening. The passage opening is preferably arranged in the throwing zone of the milling and cutting arrangement. Thereby there is made possible a direct introduction of milled and fragmented ground layer into the receiving arrangement. The passage opening can be permanently open or can be provided with a shutter or with a slider.

The milling and cutting arrangement permits not only the rapid and simple releasing and loosening of outer layers to be removed, but simultaneously their fragmentation to a grain size or to grain size ranges that permit the reinstallation of the milled and fragmented material as recycled material instead of ballast. The granulate generated by the milling process can be introduced directly into the receiving space of the receiving arrangement through a corresponding above-mentioned passage opening in the partition. If the partition is constructed as a sieve, at least in zones, or provided with a sieve, the milled material can be fragmented by the rotor and classified in one operation. Into the receiving space there passes only the constituent with the desired granulation, while coarser parts are exposed further to the rotor and broken up or allowed to lie there. This saves drive power and allows the generation of recycling material of high and uniform quality.

Alternatively, the granulate can at first remain in situ and then be taken up by the receiving arrangement in a second working operation. With the last-mentioned manner of operation parts of the released outer layer or fractions of same remain relatively longer in interaction with the milling and cutting rotor, so that there is possibly yielded a stronger or also more uniform fragmentation of the material. Independent of this, the inventive arrangement permits a separate acquisition of fragmented outer layers and of cohesive material lying under them. To this there contributes again the feature that the milling and cutting rotor preferably does not occupy the entire width of the receiving arrangement (dredge shovel). Beside the milling and cutting rotor there can be provided a control arrangement which establishes the milling depth. The guide arrangement can be formed by a guide surface range, a guide edge or a skid, which is seated on not-yet-excavated outer layer material, and slides along this. Thereby there is prevented too deep a penetration of the trench-opening arrangement into the ground in the milling-opening of the outer layer, and therewith an unintended taking-up of cohesive underground material.

If need be, here an adjustable guide element can be provided in order to adjust the milling depth. Alternatively, the position of the axis of rotation can be made adjustable, which again permits an adjustment of the milling depth. Under some circumstances this can also occur by use of different-sized rotors. In most cases, however, at least in the case of simplified embodiments, because, in many cases a uniform covering thickness is encountered in pavements, it is possible to dispense with adjustment of the milling depth.

The reinstallment of the milled covering material instead of ballast saves depositing costs and spares the environment. Furthermore, costs for the acquisition of ballast are saved, which is mostly requisite anyway.

Also the cohesive ground can be reinstalled, if need be. For this it may, if necessary, be treated with additives. For the mixing of the cohesive soil with the additives, if need be, the milling and cutting rotor can be drawn upon. First of all, the additive substance is applied to the cohesive soil, after which it is milled in by the milling and cutting rotor. This can occur before or after the excavation of the ground in situ, on the loading surface of a truck, or on an intermediate storage surface.

The arrangement is preferably provided with, or is connectable with, a weight which presses the cutting and milling arrangement against the outer layer to be broken open. With such a weight, however, not only is there brought about a contact-pressure effect, but simultaneously there is achieved a strong damping of vibrations. Wear-promoting vibrations or vibrations undesired for other reasons are absorbed near the point of origin, i.e., near the milling tool, by the mass inertia of the weight, and are thus eliminated. This makes possible again high milling performance even in the case of highly resistant outer layers.

The weight can be formed by a steel ball to be taken up by the arrangement, an otherwise constructed weight or, for example, also an especially heavily constructed outer lid element, which is swingably borne in front of the receiving opening. The outer lid element there can be both removable, freely pivotable or hydraulically pivotable. The outer lid element has the advantage of leaving the receiving space free, so that this space at least in the embodiment with a passage opening or openings between the milling tool and the receiving space, can be filled with milled material.

Other objects and advantages of the invention will become apparent upon reading the following detailed description and upon reference to the drawings, in which:

DETAILED DESCRIPTION OF THE INVENTION

Figure 1:
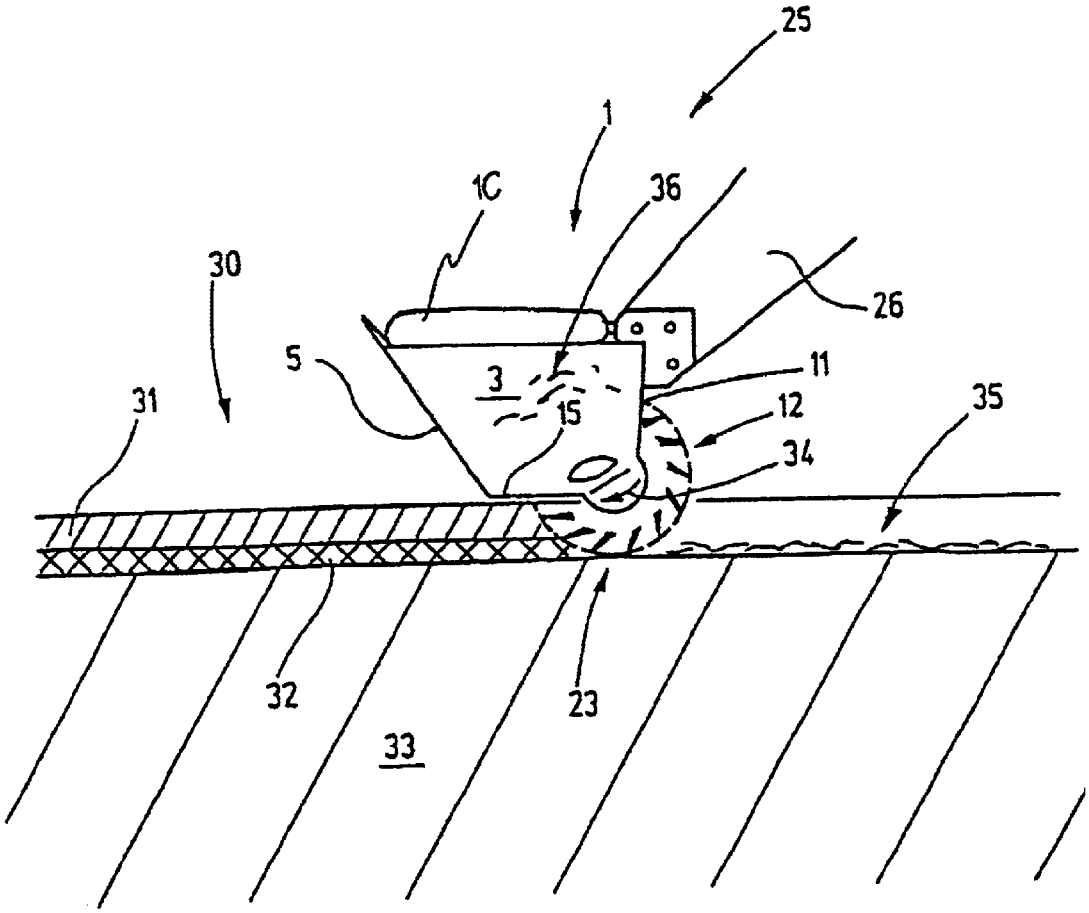
FIGS. 1–4 are schematic drawings of an exemplary outer layer loosening device constructed in accordance with the present invention showing the device in various states of operation.
Figure 5:
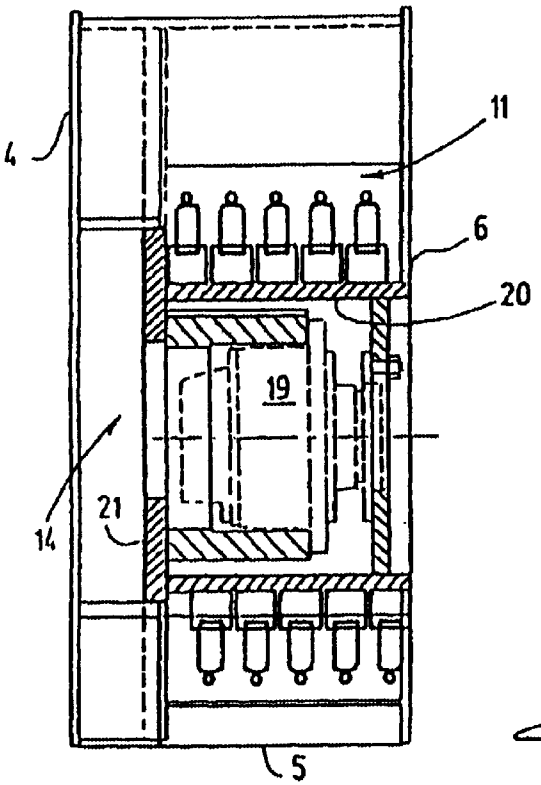
FIG. 5 is a partially sectioned rear view of the device of FIGS. 1–4.

In FIG. 1 there is shown in section and in operation, an device 1 for opening and excavating trenches. In regard to constructive details of the device 1 reference is made to FIGS. 5 and 6. As is evident from FIG. 6, the device 1 is constructed essentially as a dredging shovel with a shovel body 2. The latter has a receiving space 3 which is surrounded by flat walls, 4, 5, 6. The wall 5 forms the underside of the dredge shovel. Between the side walls 4, 5, 6 (the side wall 6 is shown in FIG. 5) there is defined a receiving opening 7 which is open over the entire width between the side walls 4 and 6. The receiving opening 7 is not covered by elements of any kind. At the end of the side wall 5 bounding the receiving opening 7, teeth 8 are provided which, as usual in a dredge shovel, are to support or facilitate the lifting-out of ground material. On the receiving opening 7 there can be provided, if need be, a weight 10 in the form of a swingably borne outer lid element which has, for example, a mass of 2 tons. The weight 10 can be borne on the dredge shovel, either freely or by means of a drive. Preferably it is separatable from the dredge shovel. Instead of the outer lid element there can also be provided weights of other types.

Figure 6:
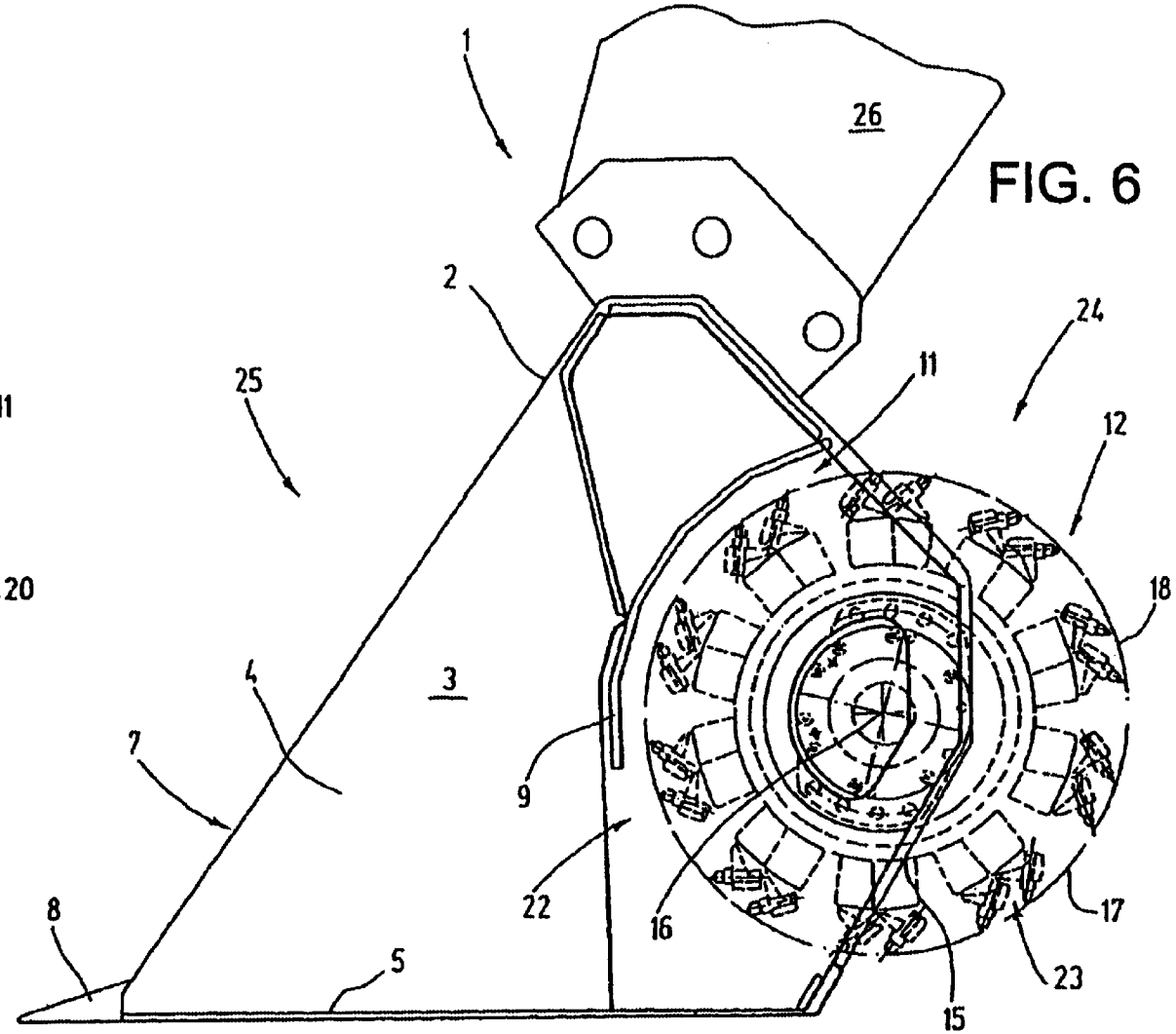
FIG. 6 is a schematic, side sectional view of the device of FIGS. 1–4.

The receiving space 3 is bounded against a chamber 11 with a partition 9, in which (chamber) a milling and cutting rotor 12 is rotatably supported. As FIGS. 5 and 6 show, the chamber 11 is arranged on the rear side of the dredge shovel and does not extend over the entire width of same. While the milling and cutting rotor 12 closes off virtually flat with the side wall 6, there remains a distance 14 from the side wall 4. The side wall 4 ends there in a support edge 15 or skid, which, as FIG. 6 shows, is rotatably supported about an axis of rotation 16 about the milling and cutting rotor 12, and its outer circumference 17. Preferably the distance between the support edge 15 and a point 18 of the circumference 17 furthest removed from this at a right angle, amounts to 20 to 30 cm. The diameter of the circumference 18 is preferably greater than half the height of the rear side.

The milling and cutting rotor 12 is arranged, furthermore, at a distance from the wall 5, i.e. the circumference 18 maintains a distance of several centimeters from the wall 5. In the interspace thus formed there is arranged a strip 18*a* or a different arrangement which has a continuous or interrupted edge extending essentially parallel to the axis of rotation 16. With its distance from the passing chisels of the milling and cutting rotor 12, this regulates the granulation of the material milled and pulverized by the milling and cutting rotor 12. The strip 18a can if necessary be adjustably borne, in order to make it possible to adjust the granulation. Alternatively, the milling and cutting rotor 12 can be adjustably borne or constructed variable in diameter.

The milling and cutting rotor 12 is connected with a preferably hydraulic drive arrangement 19, which is seated in its hub 20 and is supplied with hydraulic fluid in rank before other consumers by a control arrangement. The switching on and off occurs in each case with a gentle starting and running-out process. The drive/running arrangement 19 is supported on a carrier wall 21, which is arranged parallel between the side walls 4 and 6. In the remaining distance between the side wall 4 and the carrier wall 21 there is sufficient space for guiding the hydraulic lines that serve for the energy and power supply of the drive arrangement 19. Accordingly, no parts are present that extend beyond the side walls 4 and 6. The side walls 4 and 6, therefore, can be called upon especially in cohesive soil for the formation of smooth, straight side walls.

The intermediate wall or partition 9 can be planar or also curved, and can be designed following the circumference 18 of the milling and cutting rotor 12, at a distance; furthermore it can be closed. In the exemplary embodiment illustrated in FIG. 6, however, it is provided with a passage opening which establishes a connection between the chamber 11 and the receiving space 3. The passage opening 22 follows there directly upon the side surface 5 forming the base and lies, therefore, in the throwing range of the milling and cutting rotor 12. Its drive is established in FIG. 6 in the clockwise direction, i.e. with a viewing direction toward the rear side, the circumference 17 of the milling and cutting rotor 12 moves toward the side surface 5.

Corresponding chisels 23 borne on the hub 20 define the outer circumference 18 with their points or cutting edges. They are set obliquely against the radial direction, so that they establish a positive radial angle. In the example they are set with an angle of 45°. They are gripped in holders and are exchangeable with these. By correspondingly equipping the milling and cutting rotor with larger or smaller chisels 23 the granulation of the material can be influenced.

The chisels 23 are arranged in several rows, wherein they are offset against one another with respect to the circumferential direction so that no material remains standing between the adjacent chisels. The chisels 23 thus establish one or more cutting edges aligned parallel to the axis of rotation 16, which extend to the side surface 6. If need be, additional cutting tools can be provided in an alignment with the side surface 6, which permit an especially smooth border cut. Correspondingly on the opposite side of the rotor there can be provided a cutting arrangement closing off about with the intermediate wall 21, in order to permit here a clean and smooth edge cut. In the present embodiment the milling and cutting rotor 12 closes off with the side wall 6.

The milling and cutting rotor 12 forms in common with the drive arrangement 19 a milling and cutting arrangement 24 which is firmly joined with a receiving arrangement 25 which is formed ultimately by the receiving space 3 with its corresponding side walls 4, 5, 6 and the teeth 8. However, despite the firm connection, in a corresponding embodiment, an adjusting arrangement can be provided with which the spacing of the guide curve 15 to the point 18 is adjustable from the outer circumference 17 of the milling and cutting rotor 12, i.e. the milling depth. This can occur also by adjustment of the guide edge 15 or by adjustment of the axis of rotation 16.

The device 1, as is schematically indicated in FIG. 6, is carried by a holding and guiding arrangement 26 which is formed, for example, by the boom of an excavator.

The opening and taking-up of outer layers by the arrangement 1 occurs as follows:

As illustrated in FIG. 1, for example, a trench is to be opened in a region which is covered, for example, by a pavement 30. To the pavement 30 there belongs an asphalt outer layer 31 which lies on a substructure 32. This contains, for example, ballast and gravel. Under the substructure 32 there is present a cohesive soil 33.

Figure 2:
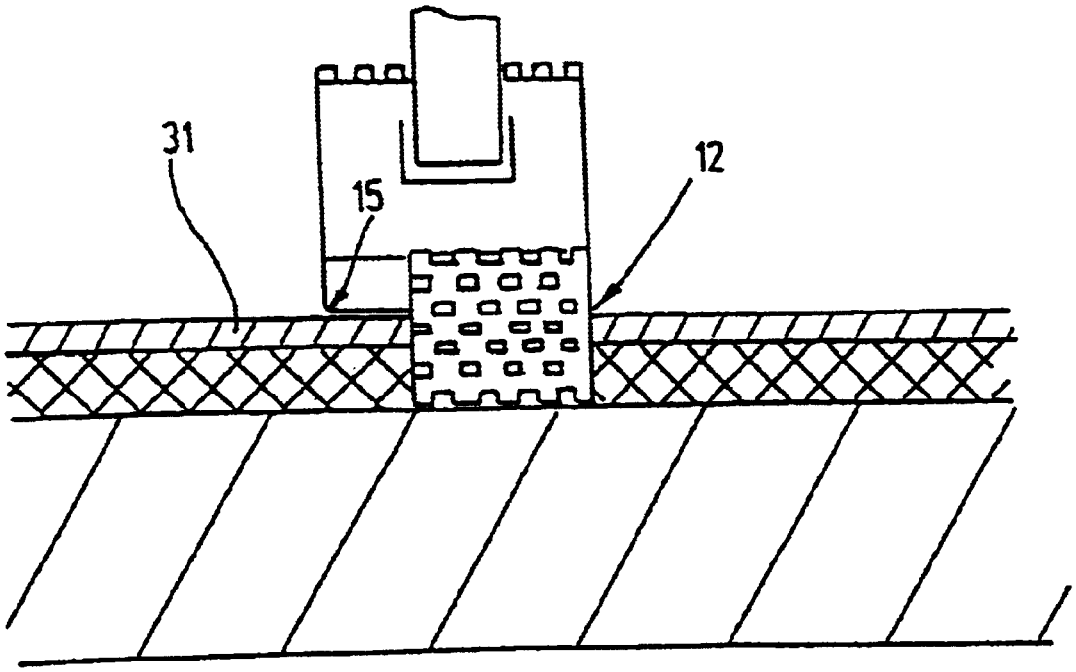

In a first working operation, the device 1 of the holding and guiding arrangement 26 is set in such a way that the rear side of the device 1 stands essentially horizontal. The side surface 5 otherwise forming the bottom is set vertically. Now the drive arrangement 19 is started in such a way that the milling and cutting rotor 12 rotates in the direction marked by an arrow 34 in FIG. 1. Simultaneously the device 1 is lowered by such a distance that the edge 15 is seated on the asphalt outer layer 31. This is to be perceived especially from FIG. 2. The milling and cutting rotor 12 thereby penetrates so far into the pavement 30 that at least the asphalt outer layer 31 is penetrated. By the rotation of the milling and cutting rotor 12 the chisels 23 break up the street covering 31 present, and parts of the substructure 32. As FIG. 1 illustrates, a part 35 of the broken-up pavement, especially the coarse constituent, remains with a granulation that does not fit between the milling and cutting rotor 12, and the strip 18*a* in the channel milled by the milling and cutting rotor 12.

By the weight 10 the vibrations arising in the milling operation are effectively damped and nearly eliminated. Furthermore, the weight 10 generates a contact-pressure force for the milling and cutting rotor 12. The working machine for the guidance of the arrangement 1 is thus relieved from static and dynamic forces.

By far the greater part of the constituent, and above all that part of it that has a sufficiently fine granulation and that fits between the milling and cutting rotor 12 and the strip 18*a*, however, is conveyed by the throwing effect of the milling and cutting rotor 12 into the interior space 3 which, as indicated schematically at 36 in FIG. 1, is gradually filled with fragments of the pavement 31. The milling and cutting rotor 12 therewith brings about a material reduction and separation. When the receiving arrangement 25 is full, the milled out pavement covering can be loaded onto a truck.

Figure 3:
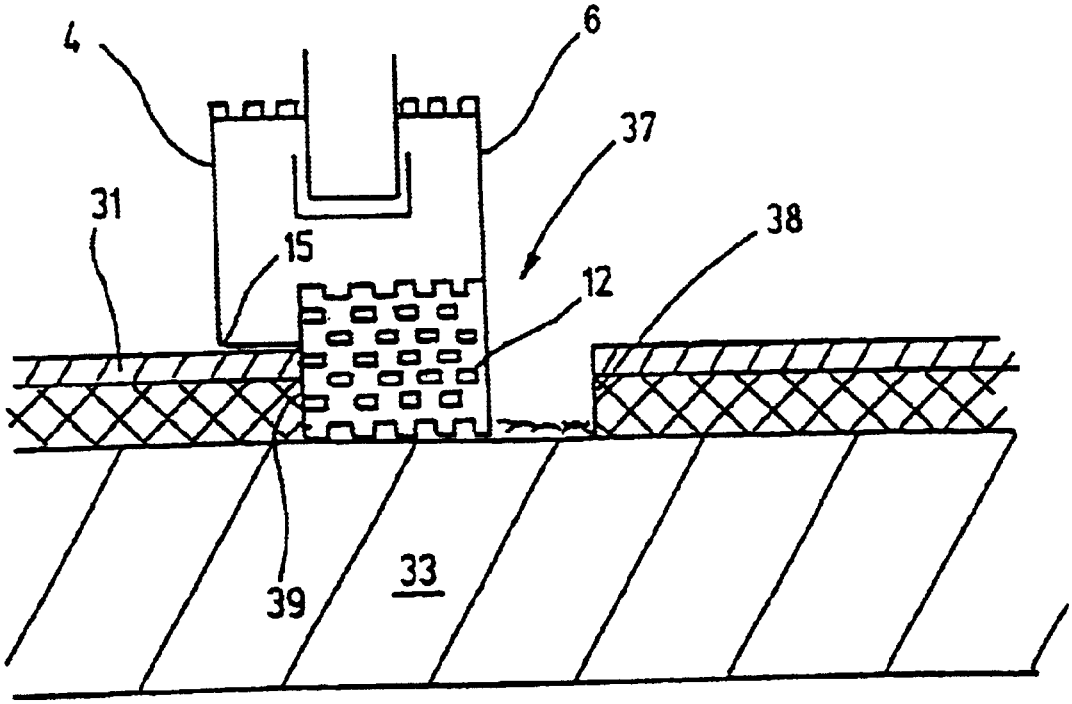

In a subsequent working operation illustrated in FIG. 3, the milling operation is repeated, laterally offset. Again the guide edge is set on the pavement covering 31, and thus it determines a uniform milling depth. Altogether there is opened a channel 37 with smooth side walls 38, 39, the spacing of which from one another corresponds essentially to the width of the dredge shovel, i.e. to the spacing of the side walls 4, 6 from one another. If need be, the spacing between the cut flanks 38, 39 can also be somewhat greater than the width of the dredge shovel (spacing of the side walls 4, 6 from one another).

Figure 4:
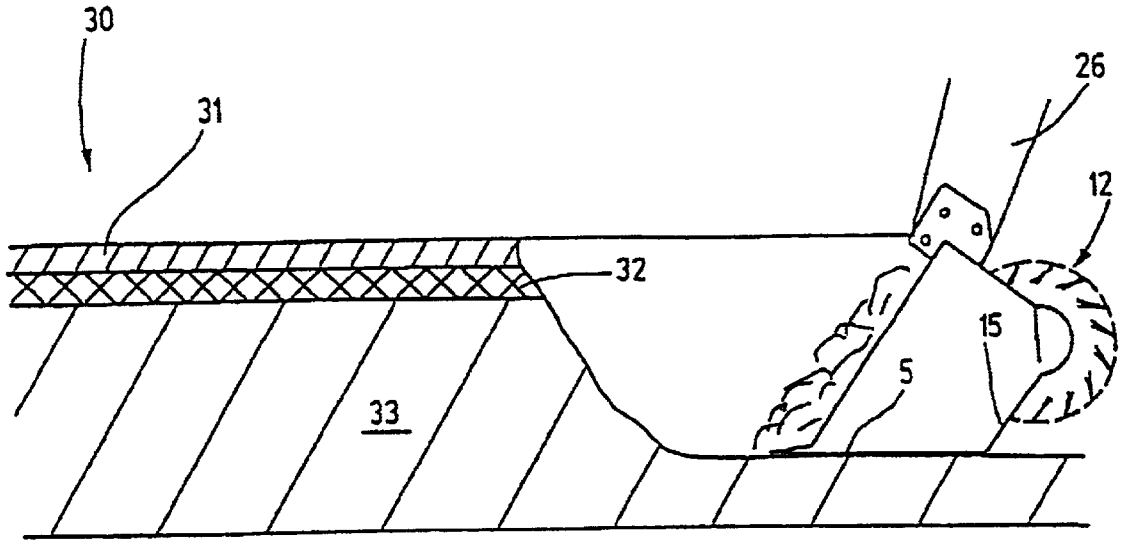

If comminuted street covering material has remained in the channel 37, this now can be taken up optionally with a usual-type excavator shovel and loaded onto a truck, or be milled again. After this, the cohesive ground 33 is accessible. Without it being necessary to carry out milling operations, this ground can be taken up, as with a usual excavator shovel, and loaded. This operation is illustrated in FIG. 4. The milling rotor 12 is inactive here and its drive arrangement 19 is halted. With the underside wall 5, which is now set horizontally, a smooth trench bottom can be formed. The milling and cutting rotor 12 does not in any way, therefore, hamper the operation of the excavator shovel.

If rocky regions appear in the underground, it may also be necessary, for advancing into greater depth, to use the milling and cutting rotor 12, and for this there can be constructed the trench flank shown on the left in FIG. 3, stepped as needed, in order to be able, in each case, to advance downward with the milling operation, over the trench bottom that is then becoming stepwise narrower.

By the milling and cutting rotor 12 the street outer layer 31 is brought to a more or less uniform granulation. At any rate, however, no excessively large fragments are present. For this reason the lifted-out material separately acquired from the cohesive ground 33 can be used as ballast and reinstalled in the closing of the trench. The cohesive ground, in contract, is again separately taken up and can likewise be reinstalled. For this, it may be necessary to work lime mortar or other additive materials into the cohesive ground, for example. For this the milling and cutting rotor 12 can be used. This can occur both in the trench before the excavating and also on a separate surface, for example beside the trench or on a loading surface of a truck, as the here deposited, excavated ground is thoroughly mixed with the additive material. This can be stored on the ground, for example. The treatment with the milling and cutting rotor 12 brings about a thorough mixture. Furthermore, the excavator shovel itself can be drawn for the mixing.

Figure 7:
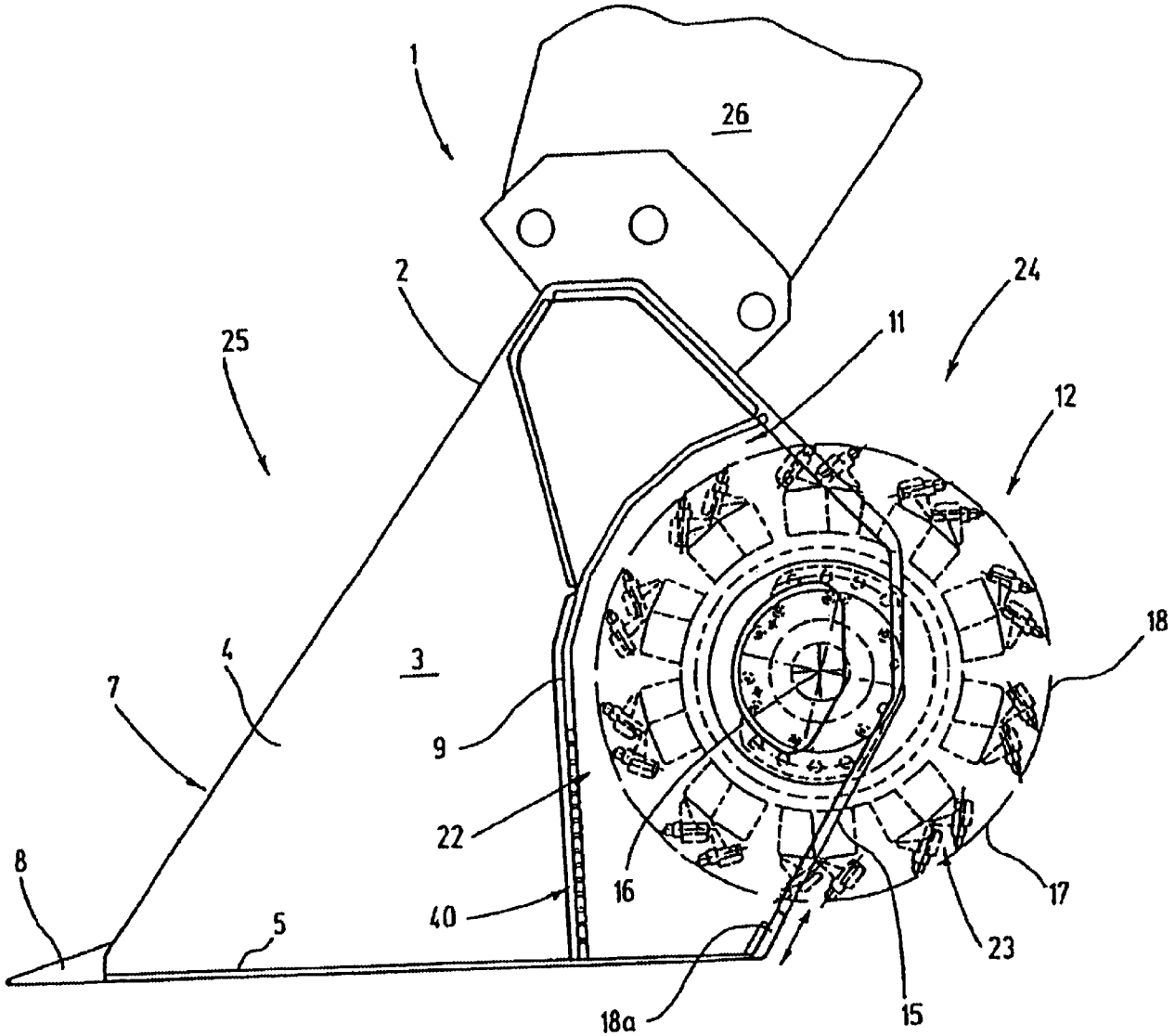
FIG. 7 is a schematic, side sectional view of an alternative embodiment of an outer layer loosening device according to the present invention.

A modified embodiment of the device 1 is illustrated in FIG. 7. Insofar that there are elements also found in the embodiment according to FIGS. 1 to 6, their reference numbers are used again and reference is made to the former specification. In distinction from the earlier described embodiment, in or on the partition a sieve 40 is provided which is mounted in the passage opening 22. The sieve limits the grain size of the material brought into the receiving space 3. Fine constituents are steadily removed from the milling space 11, while larger fragments remain exposed to the milling and cutting rotor 12 until the desired sieve fineness is reached. The sieve 40 can be changeably fastened. The device thus has two arrangements for adjusting the granulation: the strip 18*a*, which holds back excessively large fragments outside of the milling space 11, and the sieve 40 which allows fine constituents to emerge from the milling space 11. The two form in common a classifying arrangement.

Figure 8:
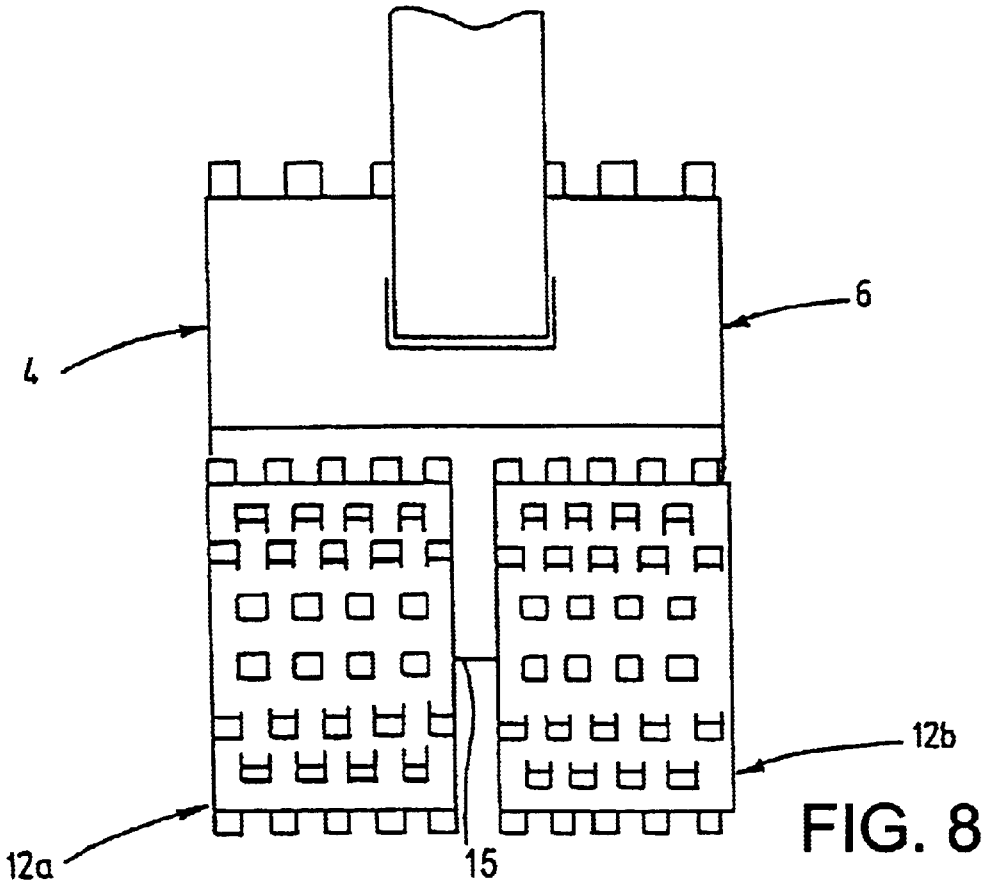
FIG. 8 is a rear view of another alternative embodiment of an outer layer loosening device according to the present invention having two motors.
Figure 9:
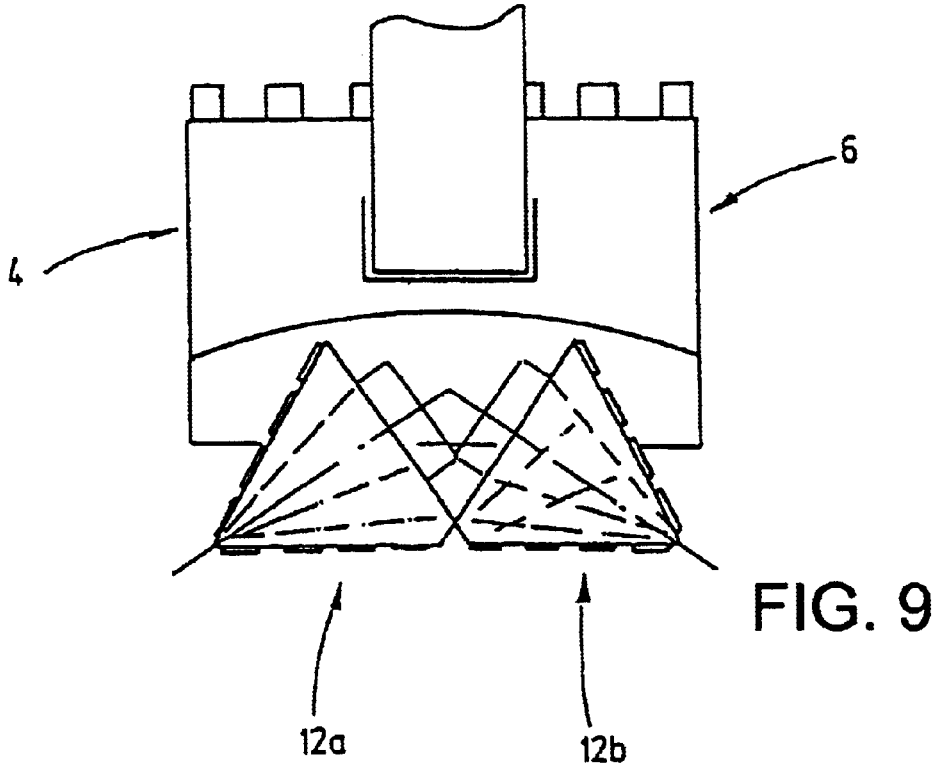
FIG. 9 is a rear view of yet another alternative embodiment of an outer layer loosening device according to the present invention having two conical rotors.

Further embodiments of the device 1 are illustrated in FIGS. 8 and 9. The two figures show, in each case, two milling and cutting rotors 12*a* and 12*b*, which are driven separately or in common. Otherwise, all the constructions described above are possible, for which reason thus far the same reference numbers are used. Differences lie in the arrangement of the rotors. The milling and cutting rotors 12*a* and 12*b* can, according to FIG. 8, laterally overhang the side walls 4, 6. The guide strip of the plate 15 can be arranged either between the milling and cutting rotors 12*a*, 12*b*or in the traveling direction, in front of these rotors 12*a*, 12*b*. The milling and cutting rotors 12*a* and 12*b* can be made disk-shaped, cylindrical, conical or otherwise.

For breaking open of ground outer layers, there serves an device 1 which is constructed as an excavator. On its rear side lying opposite the receiving opening 7 it is provided with a milling and cutting arrangement 24 which has a predetermined milling depth and serves for the penetration of the street covering 30 or similar covering layers, as well as for breaking them up into a workable recycling material.

What is claimed is:

1. A device for breaking-up of an outer layer of the ground comprising:

a milling and cutting arrangement having a milling and cutting rotor with chisels arranged for penetrating the outer layer;

a receiving arrangement connected to the milling and cutting arrangement for receiving excavated material, the receiving arrangement having a receiving space with a receiving opening lying at an opposite end of the receiving arrangement from the milling and cutting arrangement, the receiving space being separated from the milling and cutting arrangement by a partition, said partition having at least one passage opening therein for permitting communication of broken ground material between said milling and cutting rotor and said receiving space;

a drive arrangement operatively connected to the milling and cutting rotor; and a holding and guiding arrangement for carrying the milling and cutting arrangement and the receiving arrangement, the milling and cutting arrangement being held rigidly on the receiving arrangement and being arranged on a rear side thereof.

2. The device according to claim 1, wherein the milling and cutting arrangement has only one milling and cutting rotor which is provided with chisels (23) which are changeable, the milling and cutting arrangement having a milling width that is less than a lifting-out width defined by the receiving arrangement.

3. The device according to claim 1, wherein the milling and cutting arrangement has a plurality of milling and cutting rotors each of which is provided with chisels.

4. The device according to claim 1, further including a support member arranged adjacent the milling and cutting arrangement for regulating a milling depth of the milling and cutting arrangement, the support member being arranged to bear on a portion of the ground outer layer that has not been broken-up.

5. The device according to claim 1, wherein the milling and cutting arrangement is configured for a milling depth of at least 20 cm.

6. The device according to claim 1, wherein the milling and cutting rotor is arranged in a chamber which is arranged on the rear side of the receiving arrangement.

7. The device according to claim 6, wherein the milling and cutting rotor has a diameter greater than half a height of the rear side of the receiving arrangement.

8. A device according to claim 1, wherein the receiving arrangement has an underside and the milling and cutting rotor is arranged above the underside when the underside is arranged in a horizontally set position.

9. The device according to claim 8, wherein the underside of the receiving arrangement is flat.

10. The device according to claim 1, wherein the receiving arrangement is constructed as a dredging shovel.

11. The device according to claim 1, in which said receiving arrangement has a width defined by spaced apart side walls, and said milling and cutting rotor extends laterally outwardly beyond at least one of said side walls.

12. The device according to claim 1, in which said receiving arrangement has a width defined by a pair of spaced apart side walls, said milling and cutting arrangement including two milling and cutting rotors, and said milling and cutting rotors extending laterally outwardly beyond the side walls of said receiving arrangement.

13. A process for loosening of a section of the outer layer of the ground, utilizing a device including a milling and cutting arrangement having a milling and cutting rotor with chisels arranged for penetrating the outer layer, a receiving arrangement connected to the milling and cutting arrangement for receiving excavated material, the, receiving arrangement having a receiving space with a receiving opening lying at an opposite end of the receiving arrangement from the milling and cutting arrangement, a drive arrangement operatively connected to, the milling and cutting rotor; and a holding and guiding arrangement for carrying the milling and cutting arrangement and the receiving arrangement, the milling and cutting arrangement being held rigidly on the receiving arrangement and being arranged on a rear side thereof, the process comprising the steps of:

milling and fragmenting a section of an outer layer of ground with the milling and cutting rotor directing milled and fragmented ground material into said receiving space as an incident to said milling and fragmenting of the ground by the milling and cutting rotor, and collecting the milled and fragmented ground material in said receiving space.

14. The process according to claim 13, further including the step of reinstalling the collected material as recycling material.

15. The process according to claim 13, wherein the step of milling and fragmenting the section of the outer layer is carried out without previous separation of the section of the outer layer to be loosened from other sections of the outer layer.

16. The process according to claim 13, wherein in the milling and fragmenting of the section of the outer layer step the outer layer is granulated.

17. The process according to claim 13, further including the step of lifting out the underlying ground after milling and removal of the section of the outer layer.

18. The process according to claim 13, wherein the device is loaded with a weight.

19. A device for breaking-up of an outer layer of the ground comprising:

a milling and cutting arrangement having a milling and cutting rotor with chisels arranged for penetrating the outer layer;

a receiving arrangement connected to the milling and cutting arrangement for receiving excavated material, the receiving arrangement having a receiving space with a receiving opening lying at an opposite end of the receiving arrangement from the milling and cutting arrangement, the receiving space being separated from the milling and cutting arrangement by a partition, said partition being constructed at least partially as a sieve which defines a plurality of passages between said milling and cutting arrangement and said receiving arrangement;

a drive arrangement operatively connected to the milling and cutting rotor; and a holding and guiding arrangement for carrying the milling and cutting arrangement and the receiving arrangement, the milling and cutting arrangement being held rigidly on the receiving arrangement and being arranged on a rear side thereof.

20. A device for breaking-up of an outer layer of the ground comprising:

a milling and cutting arrangement having a milling and cutting rotor with chisels arranged for penetrating the outer layer, said milling and cutting arrangement including an adjustable stop strip which extends parallel to an axis of rotation of the cutting and milling rotor and which is adjustably supported at a distance from the chisels;

a receiving arrangement connected to the milling and cutting arrangement for receiving excavated material, the receiving arrangement having a receiving space with a receiving opening lying at an opposite end of the receiving arrangement from the milling and cutting arrangement, the receiving space being separated from the milling and cutting arrangement by a partition having at least one passage opening therein;

a drive arrangement operatively connected to the milling and cutting rotor; and a holding and guiding arrangement for carrying the milling and cutting arrangement and the receiving arrangement, the milling and cutting arrangement being held rigidly on the receiving arrangement and being arranged on a rear side thereof.

21. A device for breaking up an outer layer of ground comprising a milling and cutting arrangement having a milling and cutting rotor with chisels arranged for penetrating the outer layer, a drive for operatively rotating the milling and cutting rotor;

a receiving arrangement connected at one side to the milling and cutting arrangement for receiving fragmented ground material as an incident to rotation of such milling and cutting rotor, said receiving arrangement having a receiving space with a primary receiving opening on a side of the receiving arrangement opposite that which the milling and cutting arrangement is connected; and a support device for supporting and guiding movement of said milling and cutting arrangement and said receiving arrangement.

22. A device for breaking up an outer layer of ground comprising a shovel body defining a receiving space for receiving broken up ground material from a front side thereof, a support for holding and moving said shovel body, a milling and cutting rotor mounted on a rear side of said shovel body, a drive for rotating said milling and cutting rotor, and said shovel body having at least one passage opening for permitting communication of removed ground material between said milling and cutting rotor and said receiving space.

* * * * *